US006449917B1

(12) United States Patent
Sullivan, III

(10) Patent No.: US 6,449,917 B1
(45) Date of Patent: Sep. 17, 2002

(54) SUSPENDED ACOUSTICAL CEILING SYSTEM

(75) Inventor: Thomas J. Sullivan, III, Holmes, PA (US)

(73) Assignee: Sullivan Research & Development LLC, Holmes, PA (US)

( * ) Notice: Subject to any disclaimer, the term of this patent is extended or adjusted under 35 U.S.C. 154(b) by 0 days.

(21) Appl. No.: 09/496,626

(22) Filed: Feb. 2, 2000

(51) Int. Cl.[7] ..... E04B 9/00

(52) U.S. Cl. ..... 52/506.06; 52/204.1; 52/656.2; 52/656.4; 52/745.16

(58) Field of Search ..... 52/19, 205, 204.1, 52/506.06, 506.07, 506.08, 656.1, 656.2, 656.4, 745.15, 745.16

(56) References Cited

U.S. PATENT DOCUMENTS 2,854,706 A * 10/1958 Merlino ..... 52/779
2,913,571 A * 11/1959 Smith ..... 52/145 X
3,359,695 A * 12/1967 Gazerro ..... 52/127.8
3,546,842 A * 12/1970 Blum ..... 52/506.07
3,557,506 A * 1/1971 Pechenik ..... 52/309.4
4,062,164 A * 12/1977 Cousins ..... 52/506.07
4,139,972 A * 2/1979 Naka ..... 52/208
4,619,086 A * 10/1986 Naka ..... 52/205
4,843,789 A * 7/1989 Naka ..... 52/208
4,873,809 A * 10/1989 Paul ..... 52/506.07
5,444,945 A * 8/1995 Goodwin ..... 52/65
5,911,661 A * 6/1999 Murray et al. ..... 52/220.6

* cited by examiner

*Primary Examiner*—Carl D. Friedman
*Assistant Examiner*—Brian E. Glessner
(74) *Attorney, Agent, or Firm*—Morgan, Lewis & Bockius LLP

(57) ABSTRACT

A suspended acoustical ceiling access panel system includes a door frame for supporting a standard ceiling tile and hanger assemblies in the form of pivot brackets that are pivotally attached at each of opposite sides of the door frame near one end of the frame. The pivot brackets are formed to be easily slid over standard ceiling grid members and releasably clamped to the grid members while pivotally supporting the door frame. The door frame is also provided with latch members at an end of the frame opposite from the end pivotally attached to the pivot brackets and ceiling grid members. The latch members can be manually positioned to engage a ceiling grid member when the access panel system is in a closed position.

20 Claims, 8 Drawing Sheets

SUSPENDED ACOUSTICAL CEILING SYSTEM

FIELD OF INVENTION

The present invention relates to access panels for suspended acoustical ceiling systems.

BACKGROUND OF THE INVENTION

Suspended acoustical ceiling systems frequently mask functional systems such as plumbing, electrical wiring, telecommunications wiring and the like. There are two basic types of suspended acoustical ceiling systems: (1) lay-in panel systems, where the ceiling tiles are lifted into and rest in the metal grid suspension system with no physical attachment; and (2) rigid, tight systems, where the tiles are interconnected to the metal grid, locked in place and not removable.

The advantage of a lay-in suspended acoustical ceiling system is that it permits access to equipment located above the ceiling system through easily removable and replaceable ceiling tiles. The rigid spline (fixed tile) system requires use of permanent access panels or the ceiling must be disassembled and removed if work is to be completed above it.

Unfortunately, lay-in tile systems, although allowing easy access, present several difficulties. For example, since the ceiling tiles are typically identical in appearance, maintenance personnel may have to open numerous tiles in order to find the necessary access point. Also, the ceiling tiles are relatively expensive, are subject to damage whenever maintenance personnel remove and replace them, and panel edges tend to flake edge material/debris, which are deposited on the floor, equipment, or furniture below. As our technology continues to advance, the amount of communication and miscellaneous wiring extending above the ceiling in buildings is expanding and the need to access this ceiling plenum area on a routine basis is becoming commonplace. This continuous opening of typical lay-in ceilings is destructive to the ceiling tiles and grid. Strategically located access panels reduce this stress on the acoustical ceiling system and preserve the general appearance of the overall system.

Several access panel assemblies for lay-in acoustical ceiling tiles are known in the art. However, most known access panel assemblies consist of an outer frame and door with various types of hardware and clips to secure the frame to the ceiling grid. While there are many variations in existing access panel assembly design, it is believed that:

(a) the design of all existing access panel systems requires a complete outer frame around the opening and separate from the access door that reduces the size of the access panel door opening. This frame is secured to the ceiling grid system with various types of connection devices;

(b) the access panel door is hinged from the outer frame and is held in a closed position with a manually operated lock; and (c) all existing acoustical access panels weigh in excess of 2 lbs. (not including ceiling panel tile).

In addition to reducing the size of the access opening in the ceiling, the outer frame is required on existing systems to support and retain a second inner door frame that is designed to receive and hold a ceiling tile. The door frame is hinged to the outer frame and the door frame is fitted with the acoustical tile panel that matches the ceiling. As a result, conventional access panel systems require involved modifications to the acoustical ceiling grid in order to provide bracing or support for connecting and securing the access panel assembly to the acoustical ceiling grid.

SUMMARY OF THE INVENTION

In view of the above-discussed disadvantages and drawbacks of conventional access panel systems for suspended acoustical ceilings, the present invention provides a simple, inexpensive, adaptable, reliable and reusable suspended acoustical ceiling access panel assembly that minimizes the amount of materials needed and simplifies the design relative to conventional access panel assemblies. The elimination of the requirement for a separate outer frame that must be attached to the ceiling grid reduces weight, cost, and fastening requirements. The unique design utilizes the existing ceiling grid as the outer door frame. No tools are required to secure the door assembly to the ceiling grid. Further, the access panel system of the invention is significantly lighter than existing systems. As an example, the weight for a typical 24"×24"panel assembly (ceiling tile not included) is two (2) pounds minimum, to twenty (20) pounds. The system of the invention, excluding ceiling tile, weighs approximately one (1) pound.

The panel system can be provided in an assembled configuration, ready for installation of a desired ceiling tile. The placement of the hinge pivot points allows the door to swing clear of the ceiling grid in a smooth rotation. The access assembly panel is interchangeable between modular ceiling systems of the same grid size, i.e., 24"×24"–24"×48", etc. Since the access panels do not require a separate outer frame for attachment to the ceiling grid, the resulting assembly is light weight, easy to handle and provides the maximum opening possible. The access panel system is fastened to the metal ceiling grid system by lifting the door panel and hinge assembly into place and tightening thumbscrews affixed to mounting plates that engage with the ceiling grid. Relocation and reuse is readily and quickly accomplished by loosening the thumbscrews and lifting out the panel assembly for relocation to another position in a ceiling grid. The dimensions of the door panel and attachment hardware are chosen to be adaptable to all known lay-in acoustical access panel systems.

Accordingly, the present invention offers significant advantages over the known art. Apparatuses in accordance with the present invention are relatively inexpensive and easy to construct, assemble and maintain. They are easily retrofitted in place of existing dropped ceiling tiles. They permit maintenance personnel to readily identify and access key functional components, such as electrical lines, plumbing and the like. They are also aesthetically pleasing with minimal disruption to the appearance of the dropped ceiling. By eliminating the standard outer frame found in conventional systems and placing the hinge pivot points at optimal locations with connectors such as thumbscrew used to secure the assembly in place on the existing ceiling grid, this access panel assembly is lighter and easier to install than all existing known art. The door panel uses spring clips to hold the acoustical ceiling panel in place. No special attachments are required.

DETAILED DESCRIPTION OF THE PREFERRED EMBODIMENTS

Figure 1:
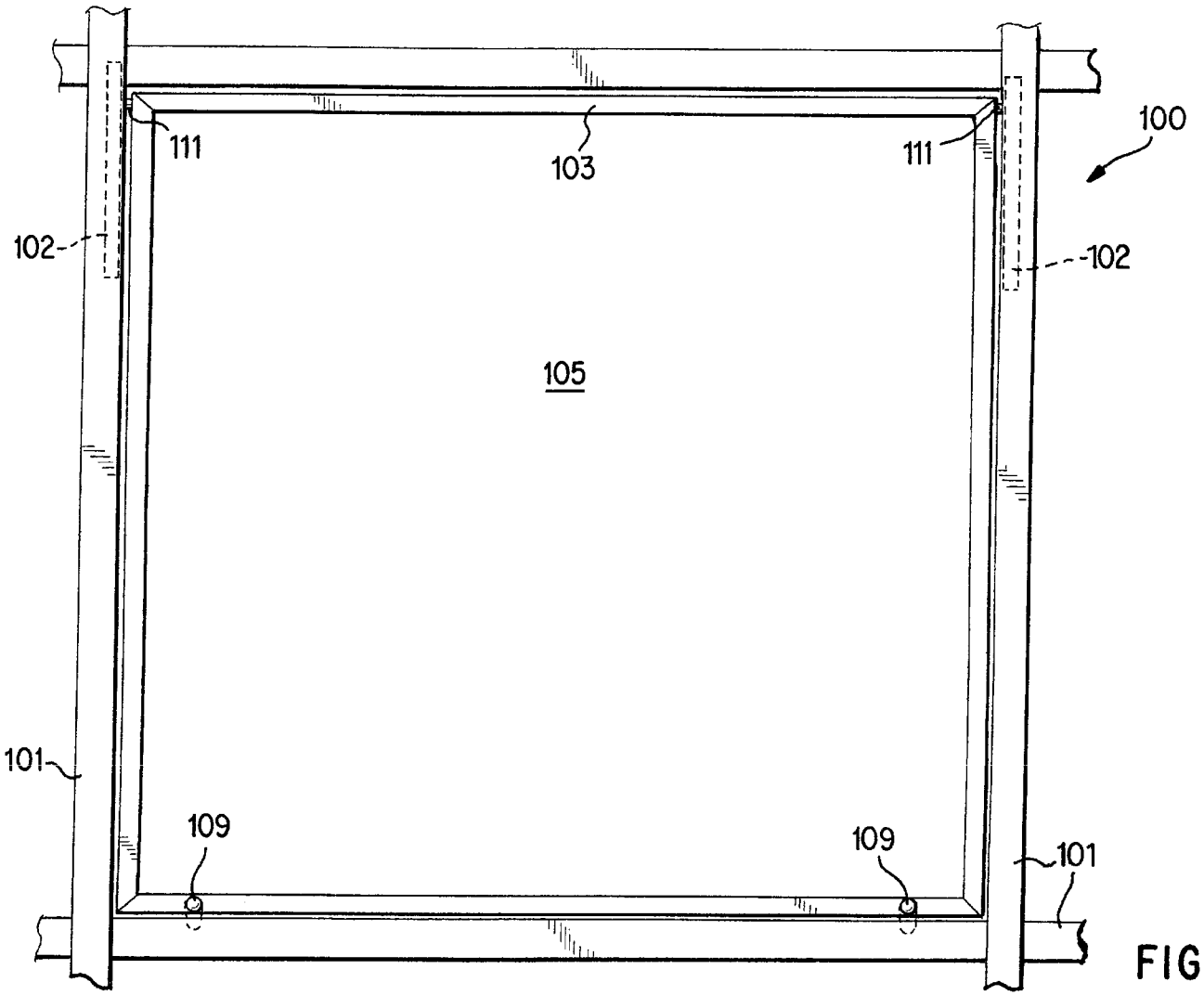
FIG. 1 shows a bottom plan view of an access panel assembly in accordance with a preferred embodiment of the present invention.

Referring in general to FIGS. 1 through 11, an access panel assembly 100 is shown for mounting in a standard suspended acoustical ceiling grid 101. The access panel assembly 100 includes a pivot bracket 102, a door frame 103, and a conventional ceiling tile 105.

Figure 2:
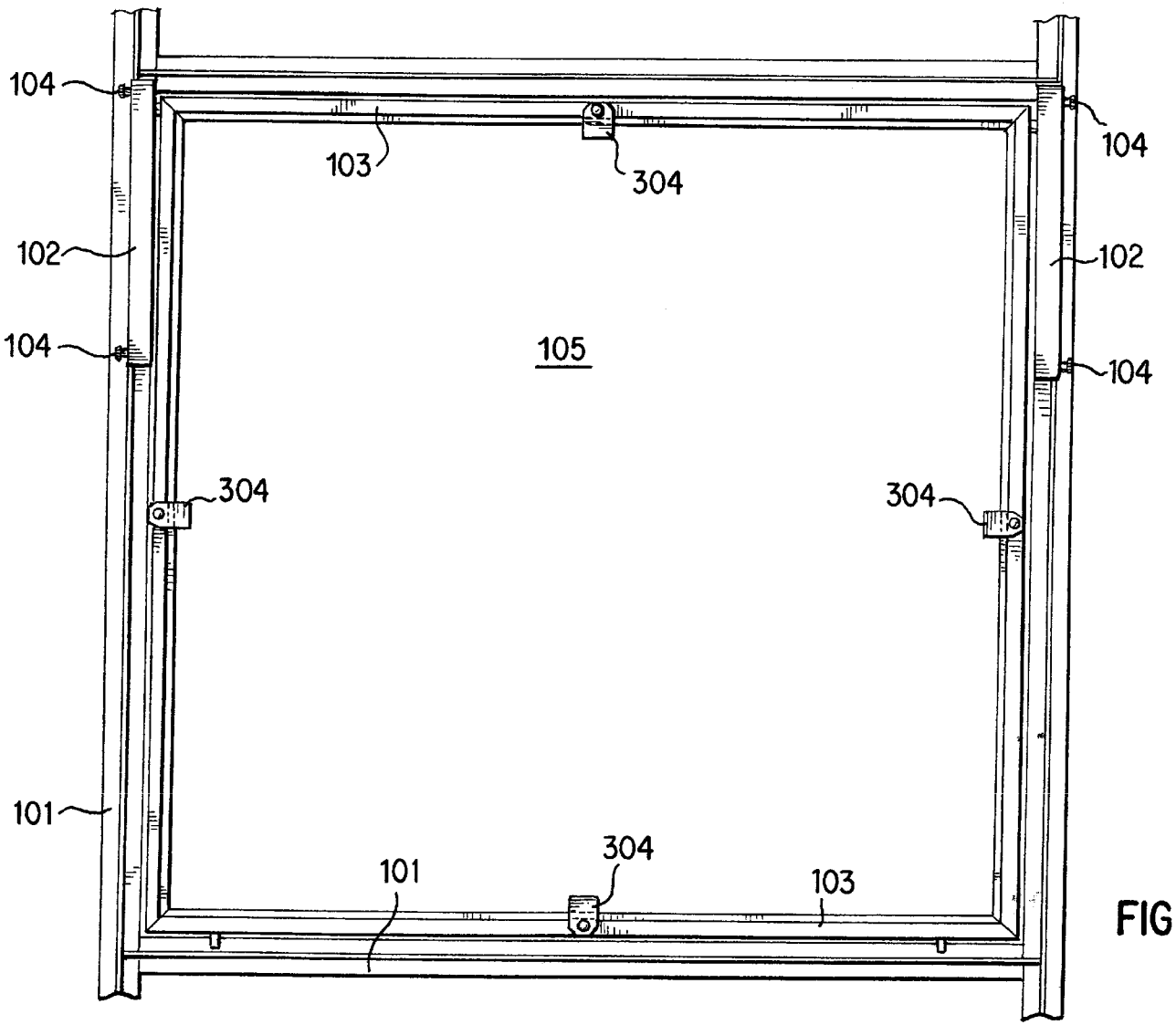
FIG. 2 shows a top plan view of the access panel assembly shown in FIG. 1.

All known conventional access panel assemblies employ an inner door frame and an outer frame assembly, with the outer frame assembly being secured to the ceiling grid by various types of fastening devices. As shown clearly in FIGS. 1 and 2, the access door assembly of the invention does not use or require a separate outer frame to provide a connection point to the suspended ceiling grid system. The connection of the panel assembly to the ceiling grid is accomplished by providing a pivot bracket 102, best seen in FIGS. 1, 2, 8 and 8A. The pivot bracket 102 includes an open rectangular metal section (channel) 110 and a closed rectangular box section 108, which together function to form a hinge bracket and ceiling grid connection system. The length of the bracket 102 is chosen to extend along a ceiling grid member a sufficient distance to provide a stable support of the access panel assembly. As seen in FIG. 2, the length of the brackets 102 on opposite sides of the opening for the door frame 103 allows for two spaced connectors 104 to attach each bracket to a corresponding section of the ceiling grid. In the preferred embodiment of the pivot bracket 102 shown in FIGS. 8 and 8A, the bracket 102 is approximately 8 inches long.

Figure 8:
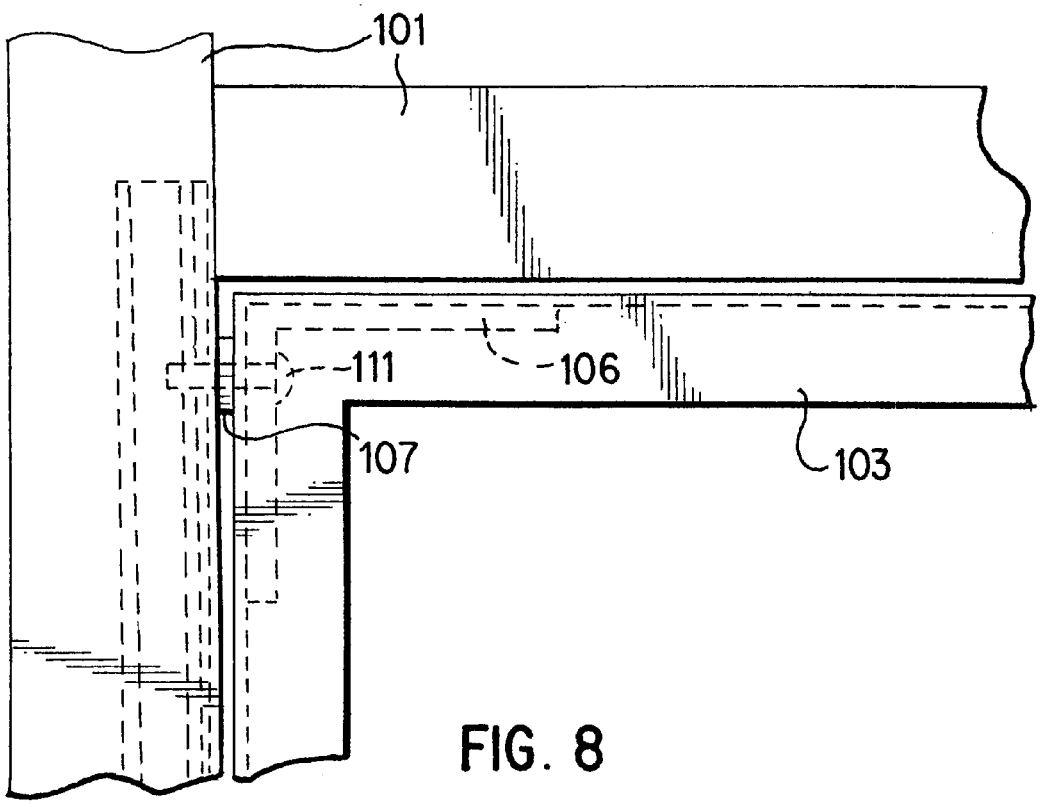
FIGS. 8 and 8A show a bottom plan view and a detailed sectional view of a hinge of an access panel assembly in accordance with a preferred embodiment of the present invention.
Figure 8A:
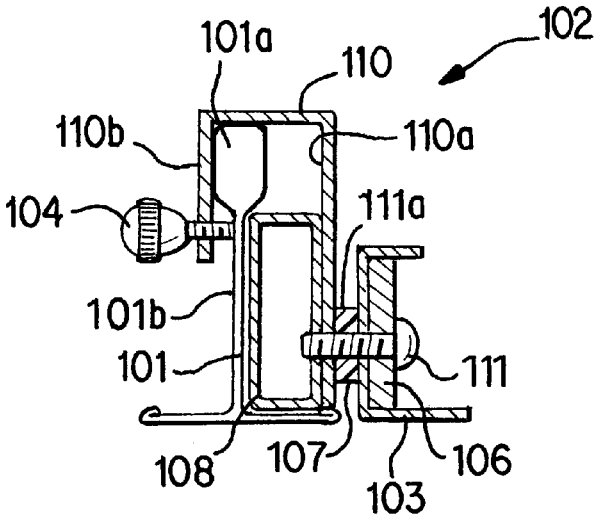

As best seen in FIG. 8A, the closed rectangular box section 108 of pivot bracket 102 can be welded or otherwise bonded along an inside surface of one leg 110*a* of the open rectangular section (channel) 110. A spaced, parallel leg 110*b* of the open rectangular section (channel) 110 fits over a top edge 101*a* of the ceiling grid 101, with the closed rectangular box section 108 being positioned adjacent the central web 101*b* of the ceiling grid 101. The double wall thickness formed along the leg 110*a* of the open rectangular section (channel) 110 by the joined box section 108 provides a thickness of metal or other suitable material sufficient to form a threaded hole to accept a pivot member such as hinge pin 111. Spacers such as nylon washers 111*a* can be placed between the door frame 103 and the pivot bracket 102 on the hinge pin 111 to maintain the inner frame centered in the opening between ceiling grid members 101 and to allow smooth, frictionless relative rotation between the door frame 103 and the pivot bracket 102.

As shown most clearly in FIGS. 1–4, the pivot bracket 102 and the door frame 103 are preferably fabricated from standard aluminum structural components such as angle stock and channel stock. The access panel door assembly 100 is sized to replace a standard suspended ceiling acoustical tile. The panel assembly 100 can be installed into the standard suspended ceiling metal grid system with the same physical motions employed to install acoustical tiles. The pivot brackets 102 are pivotally connected to opposite sides of the door frame 103 near one end of the door frame 103 by the hinge pins 111 and spacers 111*a*. As shown in FIG. 8A, the door frame 103 and pivot brackets 102 are positioned in the desired opening between ceiling grid members 101 with open rectangular sections 110 of pivot brackets 102 positioned over the top edges 101*a* of the ceiling grid members 101 and with spaced connectors 104, which are preferably thumbscrews, tightened until the central web 101*b* of each ceiling grid member 101 is clamped between the thumbscrews 104 and the closed rectangular box section 108 of each pivot bracket 102.

Figure 3:
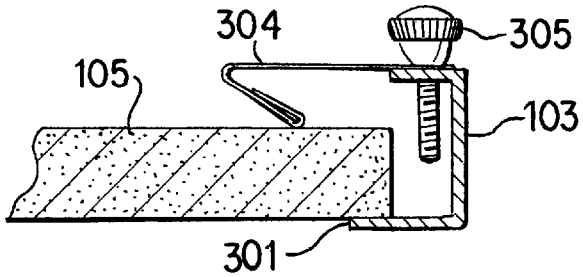
FIGS. 3 and 3A show a cross-sectional view of the door frame of the access panel assembly with ceiling tile installed and a cross sectional view of the typical channel stock used to form the door frame in accordance with a preferred embodiment of the present invention.
Figure 3A:
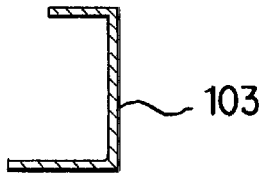
Figure 4:
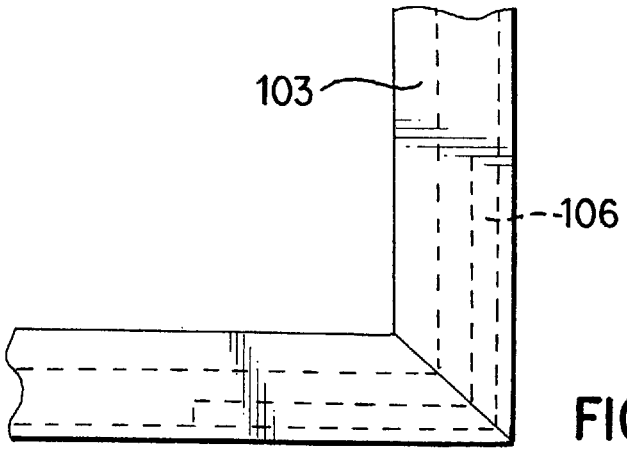
FIG. 4 shows a bottom detailed view of a comer of the door frame of an access panel assembly in accordance with a preferred embodiment of the present invention.
Figure 5:
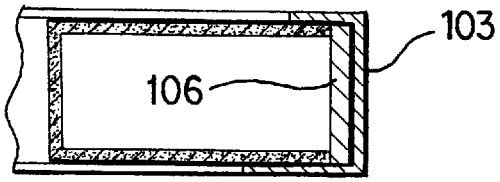
FIG. 5 shows a cross-sectional view of a portion of a comer of the door frame shown in FIG. 4.

The door frame 103 is preferably formed from channel stock, such as shown in cross section in FIGS. 3 and 3A, joined into a square and/or rectangular configuration using conventional joining techniques such as welding, brazing, bolting and/or screwing. Standard stock aluminum angles 106 can also be welded, screwed, riveted, pinned or otherwise joined to the frame comers for additional reinforcement as depicted in FIGS. 4 and 5. The additional thickness of the door frame 103 at the comers reinforced by angles 106 also provides a more stable support for hinge pins 111, as seen in FIGS. 8 and 8A. The bottom leg of the channel stock forming door frame 103 is longer than the top leg to provide a lip 301 for supporting a standard ceiling tile 105, such as shown in FIG. 3.

As shown most clearly in FIG. 3, the ceiling tile 105 is preferably removably coupled to the door frame 103. The ceiling tile lO5 preferably rests on the lower lip 301 of the door frame 103 and is held in place by a suitable removable spring fastener, such as the resilient clip 304. The resilient clip 304 is preferably removably fastened to the door frame 103 by a suitable fastener, such as thumbscrew 305. Alternative fasteners for fastening the ceiling tile 105 to the door frame 103 might include swivel clips or other spring-type fasteners, as long as they permit fastening and unfastening of the ceiling tile 105 to the door frame 103. The fitting of ceiling tile to frame is similar to the process of fitting a ceiling tile in a border location, i.e., around the perimeter in conventional ceiling panel systems.

Figure 6:
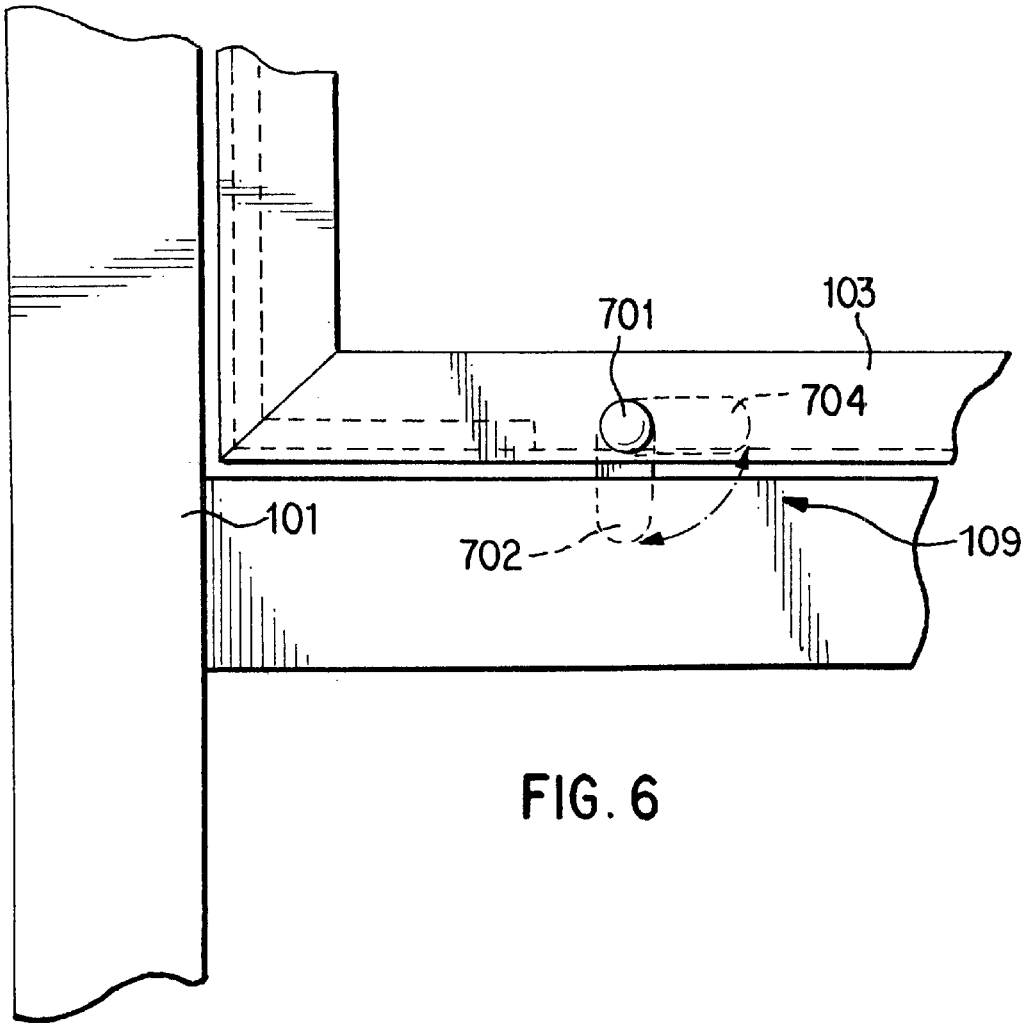
FIGS. 6 and 6A show a bottom plan view and a detail view of a latch of an access panel assembly in accordance with a preferred embodiment of the present invention.
Figure 6A:
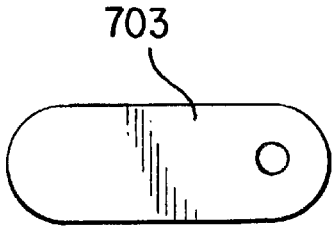
Figure 7:
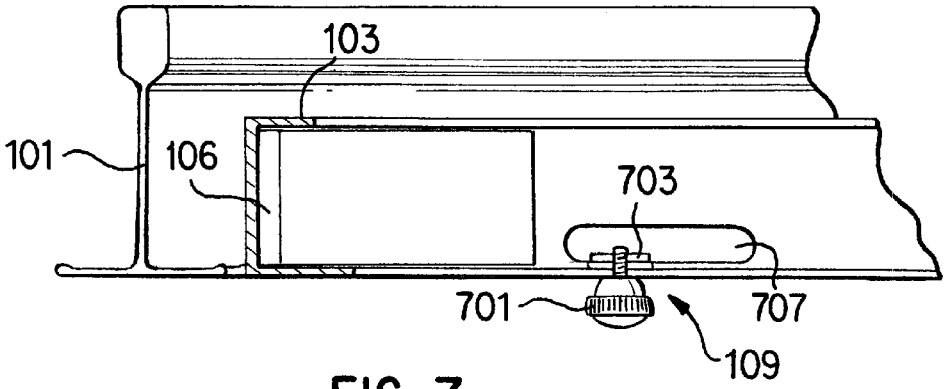
FIGS. 7 and 7A show a side elevation view and a detailed sectional view of a latch of an access panel assembly in accordance with a preferred embodiment of the present invention.
Figure 7A:
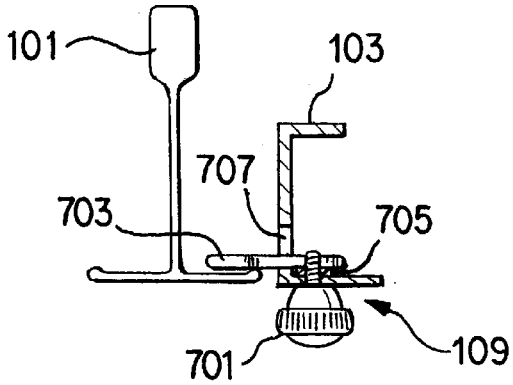

Referring to FIGS. 6, 6A, 7 and 7A, latch assemblies 109 secure the door frame 103 to the ceiling grid 101 in a closed position. The latches are located at the edge of the access door frame 103, at an opposite end of the frame 103 from the hinge pins 111. In a preferred embodiment, each latch assembly 109 includes a thumbscrew 701 attached to a swivel plate 703. The latch assembly is coupled to the bottom (lower surface) of the door frame 103. The swivel plate 703 attached to the end of the thumbscrew 701 is separated by a nylon washer 705 from the door frame 103, as best seen in FIG. 7A. A slot 707 is formed through door frame 103 adjacent to the latch assembly 109 to provide clearance for the swivel plate 703 when the latch assembly 109 is operated (rotated) into an extended position for maintaining the door in a closed position.

When the latch assembly 109 is in a first position 702 as shown in FIG. 6, the swivel plate 703 engages the top surface of the ceiling grid 101, so that the door frame 103 is held in a closed position. When the latch 109 is rotated to a second position 704 (see FIG. 6), the swivel plate 703 does not engage the ceiling grid 101, so that the door frame 103 is free to open by pivoting around hinge pins 111. While many types of openable latch mechanisms may be suitable, in a preferred embodiment, the latch 109 may be opened and closed manually without tools.

As shown in FIGS. 9, 9A, 10, and 11, a variety of ceiling systems and size installation techniques may be used to incorporate the access panel system 100 into a modular suspended ceiling system.

Figure 9:
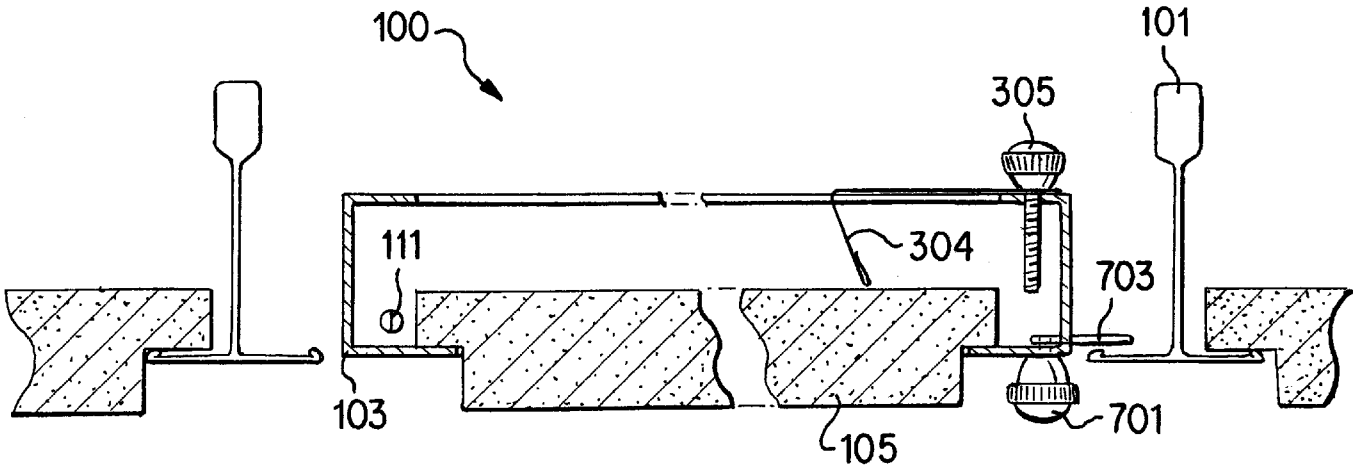
FIGS. 9 and 9A show a side cross-sectional view of an access panel assembly with reveal edge tile and a detail view of a typical tile retention/hold down clip for an access panel assembly in accordance with a preferred embodiment of the present invention.
Figure 9A:
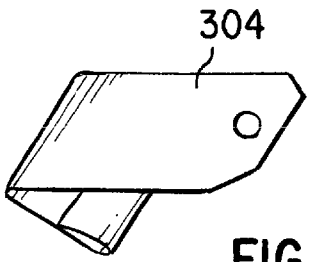
Figure 10:
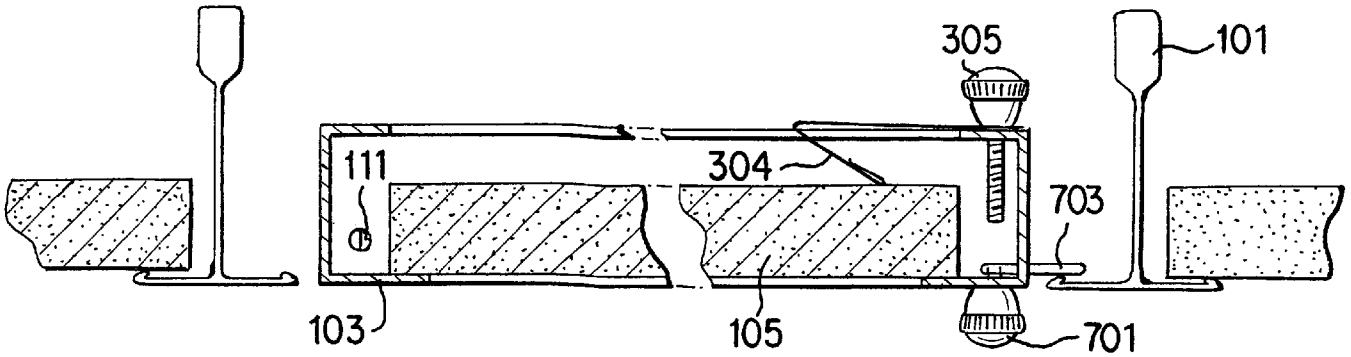
FIGS. 10 and 11 show side cross-sectional views of an embodiment of the invention used with either lay-in tile or concealed ceiling tile.
Figure 11:
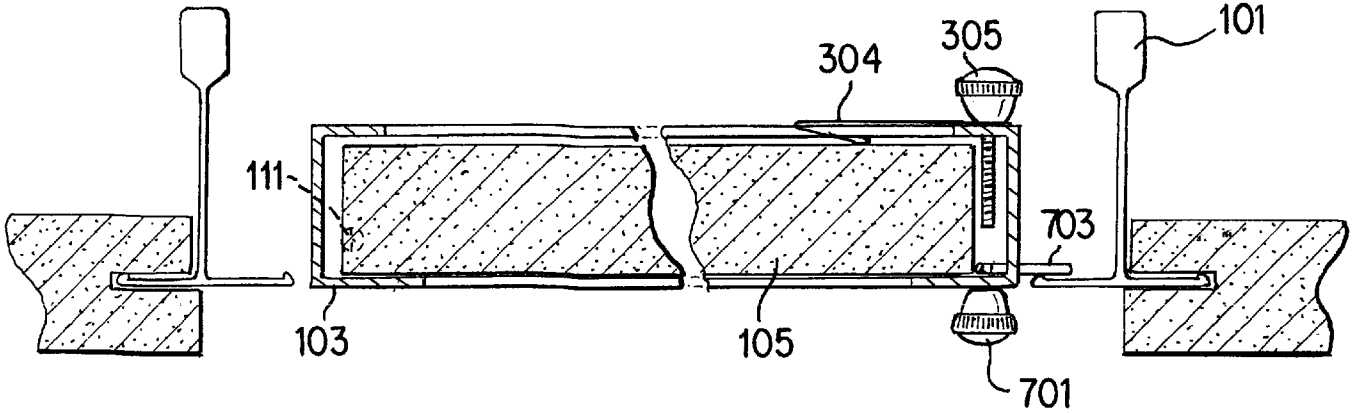

FIG. 9 shows the access panel assembly 100 installed in a standard ceiling grid with reveal edge tiles. In this configuration, as with all the configurations shown in FIGS. 9–11, the door frame 103 is suspended within the ceiling grid 101 at one end by hinge pins 111, and at the other end by swivel plates 703 when the access panel is in a closed configuration. FIG. 10 shows an access panel in accordance with the present invention installed in a standard ceiling grid with lay-in ceiling tiles. FIG. 11 shows an access panel in accordance with the present invention installed in a concealed spline grid and tile ceiling. In all of the illustrated configurations, a closed access panel assembly 100 may be opened by grasping the thumbscrews 701 and turning them so that the swivel plates 703 of latch assemblies 109 are moved from the closed position to the open position. The door frame 103 may then be lowered to hang freely from the hinge pins 111 to permit access to functional elements normally concealed by the access panel assembly 100.

It will be understood that various changes in the details, materials and arrangements of the parts which have been described and illustrated in order to explain the nature of this invention may be made by those skilled in the art without departing from the principles and scope of the invention as expressed in the following claims. As an example, the material for forming the door frame and pivot brackets could be an injection-molded plastic rather than aluminum. The pivot brackets could be formed from a variety of materials, including injection-molded plastic, and could be configured in a variety of ways that allow the brackets to be easily slipped over the existing ceiling grid members and manually clamped to the ceiling grid members to provide a secure pivotal attachment for the access panel assembly.

What is claimed is:

1. A suspended ceiling access panel system, comprising:

a door frame including a top surface and a bottom surface; and a hanger assembly, wherein the hanger assembly is configured for clamping directly onto a ceiling grid member and the frame is pivotally coupled to the hanger assembly at a pivot location such that the frame pivots with respect to the hanger assembly, the frame is adapted to removably receive a standard ceiling-type tile such that the ceiling-type tile rests on the bottom surface of the frame and the pivot location is located above the bottom surface of the frame.

2. The suspended ceiling access panel system of claim 1, wherein the hanger assembly is adapted to be manually clamped to a ceiling grid member.

3. The suspended ceiling access panel system of claim 2, wherein the hanger assembly includes thumbscrews for releasably clamping to a ceiling grid member.

4. The suspended ceiling access panel system of claim 3, wherein a hanger assembly is pivotally coupled to each of opposite sides of said door frame near a first end of said door frame.

5. The suspended ceiling access panel system of claim 4, wherein the door frame includes latch members for engagement with a ceiling grid member when the access panel system is in a closed position, the latch members being positioned at a second end of said frame opposite from said first end.

6. The suspended ceiling access panel system of claim 5, wherein the door frame is formed from channel members and a flange on at least one of said channel members provides a surface for supporting a standard ceiling-type tile.

7. A suspended ceiling access panel system, comprising:

a door frame including a top surface and a bottom surface for supporting a ceiling tile, said door frame having a proximal end and a distal end; and first and second brackets pivotally connected to opposite sides of said door frame at said proximal end and at a position above a plane containing said bottom surface of the door frame, each of said brackets being configured for engagement with a ceiling grid member in a suspended ceiling, and each of the brackets having a largest length that is less than a largest length of one of the opposite sides of the door frame.

8. The suspended ceiling access panel system according to claim 7, wherein said door frame includes latch members connected to said door frame at said distal end for selective engagement with a ceiling grid member in a suspended ceiling.

9. The suspended ceiling access panel system according to claim 8, wherein said brackets include means for manually clamping said brackets to a ceiling grid member in a suspended ceiling.

10. The suspended ceiling access panel system according to claim 9, wherein said means for manually clamping said brackets to a ceiling grid member includes thumbscrews.

11. The suspended ceiling access panel system according to claim 7, wherein said door frame is formed from channel-like structural components, and said brackets are shaped for ready installation on a ceiling grid member by slipping said brackets down over the ceiling grid member and manually clamping the brackets to the ceiling grid member.

12. The suspended ceiling access panel system according to claim 11, wherein said brackets include thumbscrews for manually clamping the brackets to a ceiling grid member.

13. The suspended ceiling access panel system according to claim 12, wherein said door frame includes latch members connected to said door frame at said distal end for selective engagement with a ceiling grid member in a suspended ceiling.

14. The suspended ceiling access panel system according to claim 13, wherein said latch members include a thumbscrew fixed to an elongated latch plate, and rotation of said thumbscrew moves said latch plate between a position extending from the distal end of the door frame for engagement with a ceiling grid member and a position contained within the door frame for allowing the door frame to pivot about the proximal end of the door frame relative to the ceiling grid member.

15. The suspended ceiling access panel system according to claim 14, wherein each of said brackets is shorter in length than a side of said door frame to which the bracket is pivotally connected.

16. The suspended ceiling access panel system according to claim 15, wherein each of said brackets is pivotally connected to said door frame by hinge pins passing through said door frame near said proximal end of said door frame and through an opening in each of said brackets.

17. A method of installing a ceiling access panel system, wherein said ceiling access panel system includes two brackets, each pivotally connected to opposite sides of a door frame for supporting a ceiling tile and being pivotally connected to the door frame adjacent a proximal end of the door frame, the method comprising the steps of:

removing a ceiling tile from a group of ceiling grid members;

inserting the proximal end of the door frame with pivotally connected brackets up through the opening between the ceiling grid members left by the removal of the ceiling tile;

lowering the brackets down over ceiling grid members positioned adjacent the opposite sides of the door frame; and manually clamping the brackets to the ceiling grid members.

18. The method according to claim 17, wherein said brackets are manually clamped to the ceiling grid members by tightening thumbscrews on said brackets against the ceiling grid members.

19. The method according to claim 18, further including the step of placing a ceiling tile into said door frame and securing the ceiling tile relative to the door frame.

20. The method according to claim 19, further including the step of pivoting said door frame about said brackets relative to the ceiling grid members until said door frame and ceiling tile are substantially parallel with the ceiling grid members and latching the door frame to a ceiling grid member at a distal end of the door frame opposite from the proximal end.

* * * * *